United States Patent [19]

Holden et al.

[11] Patent Number: 4,478,154

[45] **Date of Patent: * Oct. 23, 1984**

[54] PEDESTAL LINER FOR RAILWAY VEHICLE AND METHOD OF MAKING SAME

[75] Inventors: Homer N. Holden, Jackson County, N.C.; Donald L. Kleykamp, Washington Township, Montgomery County, Ohio; William F. Moore, Cherokee Village, Ark.; Julien C. Mathieu, Waynesville, N.C.

[73] Assignee: Dayco Corporation, Dayton, Ohio

[ * ] Notice: The portion of the term of this patent subsequent to Feb. 2, 1999 has been disclaimed.

[21] Appl. No.: 330,629

[22] Filed: Dec. 14, 1981

Related U.S. Application Data

[63] Continuation-in-part of Ser. No. 167,292, Jul. 10, 1980, Pat. No. 4,313,384.

[51] Int. Cl.[3] ..... B61F 5/32

[52] U.S. Cl. ..... 105/225; 29/149.5 NM; 29/458

[58] Field of Search ..... 29/149.5 R, 149.5 S, 29/149.5 NM, 458; 105/199 C, 199 CB, 207, 221 R, 225

[56] References Cited

U.S. PATENT DOCUMENTS

| | | | |
|---|---|---|---|
| 3,554,618 | 1/1971 | Ditzler et al. | 308/3 |
| 4,170,180 | 10/1979 | Houston | 105/225 |
| 4,188,888 | 2/1980 | Cooper et al. | 105/199 C |
| 4,237,793 | 12/1980 | Holden et al. | 105/225 |
| 4,239,007 | 4/1979 | Kleykamp et al. | 105/225 |
| 4,313,384 | 2/1982 | Holden et al. | 105/225 |
| 4,333,404 | 6/1982 | Kleykamp | 105/225 |

OTHER PUBLICATIONS

Serial No. 160,059, filed Jun. 16, 1980.

*Primary Examiner*—Randolph Reese
*Assistant Examiner*—David F. Hubbuch
*Attorney, Agent, or Firm*—Joseph V. Tassone

[57] ABSTRACT

A pedestal liner for a railway vehicle and method of making same are provided wherein such liner comprises a roughly U-shaped metal support comprising the main structural portion of the liner with the metal support having a bight and a pair of parallel legs and an insert is provided and carried by the metal support. The insert has a pair of roughly parallel members which have outer portions disposed outwardly of and parallel to the parallel legs of the support and the parallel members are comprised of antifriction material; and, the insert has an integral arm extending transverse its members with the arm also being comprised of antifriction material. The insert is adapted to be readily installed on and removed from the metal support and is held in position mainly by surface portions of the metal support to define the pedestal liner.

20 Claims, 14 Drawing Figures

PEDESTAL LINER FOR RAILWAY VEHICLE AND METHOD OF MAKING SAME

CROSS-REFERENCE TO RELATED APPLICATION

This application is a continuation-in-part patent application of its copending parent patent application, Ser. No. 167,292, filed July 10, 1980 now U.S. Pat. No. 4,313,384, issued on Feb. 2, 1982.

BACKGROUND OF THE INVENTION

1. Field of the Invention

This invention relates to railway vehicles and more particularly to pedestal liners for pedestral trucks of railway vehicles.

2. Prior Art Statement

Pedestal liners are widely used in the railway industry for the purpose of protecting the relatively slidable surfaces of a pedestal leg and journal box of a pedestal truck against excessive wear.

For example, U.S. Pat. No. 3,554,618 discloses a U-shaped pedestal liner consisting of a bight and a pair of parallel legs which has an inserted nylon wear plate for the bight which is unsupported in the central portion of the bight and which is free of antifriction material on the outside surfaces of the parallel legs where substantial wear may also occur in a pedestal liner.

U.S. Pat. No. 4,170,180 discloses a pedestal liner comprised of two main components wherein one component is U-shaped and made entirely of polymeric material and the other component is a sheet-like insert also made entirely of polymeric material.

Copending U.S. Patent application Ser. No. 30,035, filed Apr. 13, 1979, now U.S. Pat. No. 4,237,793, discloses a U-shaped pedestal liner having a bight and a pair of parallel legs and such liner is comprised of a continuous uninterrupted metal backing material defining the bight and parallel legs and antifriction material in the form of an ultra high molecular weight polymeric material fixed against the bight and parallel legs of the backing material whereby the backing material provides optimum support for the antifriction material.

Copending U.S. Patent application Ser. No. 30,036, filed Apr. 13, 1979, now U.S. Pat. No. 4,239,007, discloses a U-shaped pedestal liner having a bight and a pair of parallel legs. A first antifriction material is fixed against the bight and a second antifriction material is fixed against the parallel legs with the first and second antifriction materials being ultra high molecular weight polymeric materials having different wear characteristics.

U.S. Pat. No. 4,188,888 discloses a wear member or liner for center plate structure of a railway vehicle which has reinforcing material embedded therein.

Finally, copending U.S. Patent application Ser. No. 160,059 now U.S. Pat. No. 4,333,404, issued June 6, 1984, filed June 16, 1980, discloses a pedestal liner comprised primarily of antifriction material in the form of ultra high molecular weight polymeric material and which has a reinforcing structure embedded in the polymeric material which serves as a matrix therefor and substantially completely surrounds such structure and the structure has openings therein for receiving the polymeric material completely therethrough thereby enabling better embedment of the structure and the structure provides reinforcement and prevents cold flow of the polymeric material.

SUMMARY

It is a feature of this invention to provide a U-shaped pedestal liner for use between a pedestal leg and journal box of a railway pedestal truck wherein such liner may be attached in position in a high strength manner yet utilizes a minimum amount of antifriction material resulting in the pedestal liner being of optimum economy.

Another feature of this invention is to provide a pedestal liner of the character mentioned wherein such liner comprises a roughly U-shaped metal support comprising the main structural portion of the liner with the metal support having a bight and a pair of parallel legs and which utilizes an insert carried by the metal support. The insert has a pair of roughly parallel members which have outer portions disposed outwardly of and parallel to the parallel legs of the support and the parallel members are comprised of antifriction material; and, the insert has an integral arm extending transverse its members with the arm also being comprised of antifriction material. The insert is adapted to be readily installed on and removed from the metal support and is held in position mainly by surface portions of the metal support to define the pedestal liner.

Another feature of this invention is to provide a pedestal liner of the character mentioned in which the metal support thereof provides the main advantages of an all metal liner and the insert thereof provides the main advantages of a liner made substantially entirely of antifriction polymeric material.

Another feature of this invention is to provide a pedestal liner of the character mentioned in which the antifriction polymeric material comprising such insert is ultra high molecular weight polymeric material.

Another feature of this invention is to provide a pedestal liner of the character mentioned in which the ultra high molecular weight polymeric material is polyethylene.

Another feature of this invention is to provide a pedestal liner of the character mentioned in which the parallel members of the insert are disposed in spaced apart parallel planes and the transverse arm of the insert extends in a plane substantially perpendicular to the parallel planes of the members with such arm adjoining associated side edges of such members.

Another feature of this invention is to provide a pedestal liner of the character mentioned in which the insert is a substantially H-shaped insert.

Another feature of this invention is to provide a pedestal liner of the character mentioned in which the insert is a substantially U-shaped insert.

Another feature of this invention is to provide a pedestal liner of the character mentioned in which the insert is substantially U-shaped and has a bight which has a vertical height which is greater than the vertical height of its parallel legs.

Another feature of this invention is to provide a pedestal liner of the character mentioned in which the insert thereof is adapted to be installed in position on its associated U-shaped metal support by movement thereof generally in a direction from the bight of its metal support toward the parallel legs of such metal support with the parallel members of the insert being disposed in an embracing relation around the legs of the metal support.

Another feature of this invention is to provide a pedestal liner of the character mentioned in which the insert thereof is adapted to be installed in position on its associated U-shaped metal support by movement thereof generally through the parallel legs of the metal support and toward the bight of such metal support.

Another feature of this invention is to provide a pedestal liner of the character mentioned having an insert which is, in essence, self held mainly by cooperating surface portions of the insert which engage similarly shaped and formed surface portions of the metal support.

Another fearure of this invention is to provide an improved method of making a pedestal liner of the character mentioned.

Therefore, it is an object of this invention to provide an improved pedestal liner and method of making same having one or more of the novel features set forth above or hereinafter shown or described.

Other details, features, uses, objects, and advantages of this invention will become apparent from the embodiments thereof presented in the following specification, claims, and drawings.

BRIEF DESCRIPTION OF THE DRAWINGS

The accompanying drawings show present preferred embodiments of this invention, in which.

DETAILED DESCRIPTION

Figure 1:
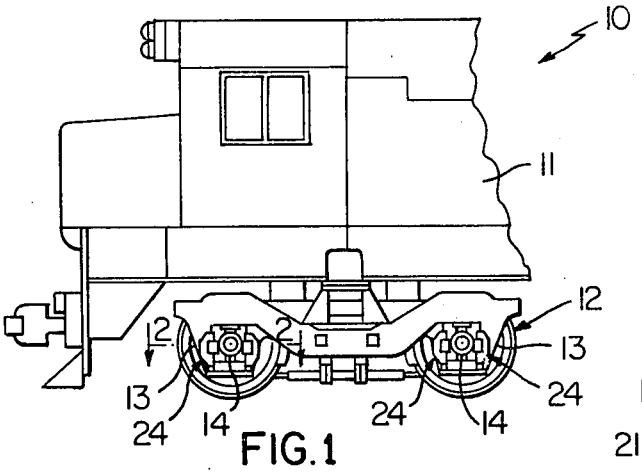
FIG. 1 is a fragmentary side view of a railway locomotive comprising pedestal trucks at its opposite ends and wherein each truck has pairs of pedestal legs and a journal box disposed between each pair of associated pedestal legs with a pedestal liner of this invention being disposed between each associated pedestal leg and journal box.

Reference is now made to FIG. 1 of the drawings which illustrates a fragmentary portion of a railway vehicle which is shown as a portion of a railway locomotive and is designated generally by the reference numeral 10. The locomotive 10 comprises the usual locomotive main body 11 which is supported at each of its opposite ends by a four wheel truck and one of the trucks is shown in FIG. 1 and desinated generally by the reference numeral 12. Each truck 12 is a so-called pedestal type truck, which is well known in the locomotive art, and comprises four pairs of pedestal legs with a typical one of such pedestal legs being illustrated in enlarged view in FIG. 2; and, each leg of each pair is designated by the reference numeral 13. The truck 12 has the usual journal box 14 disposed between each associated pair of legs 13.

Figure 2:
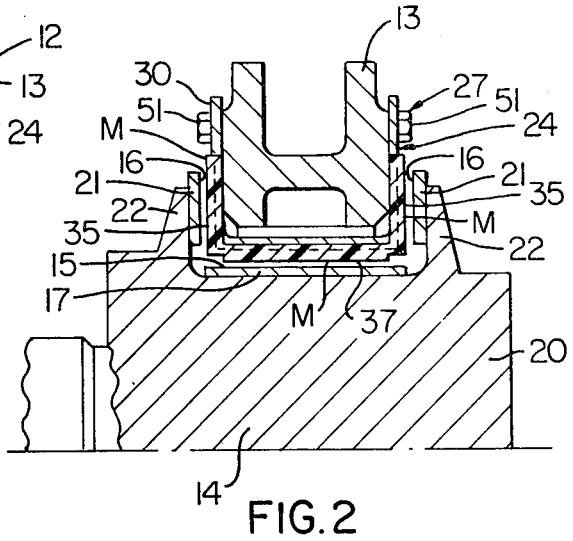
FIG. 2 is a fragmentary enlarged cross-sectional view with parts in cross section and parts in elevation taken essentially on the line 2—2 of FIG. 1 and illustrating a typical pedestal liner of this invention disposed in position between an associated journal box and pedestal leg.

As best seen in FIG. 2, each journal box 14 has a vertically disposed central planar guide surface 15 and a pair of spaced vertically disposed parallel side surfaces 16 disposed on opposite sides of each central guide surface 15. Each central guide surface 15 defines the outside surface of an associated wear plate 17 which is suitably fixed to the main body 20 of the journal box 14 by any suitable means, such as welding, or the like. The side surfaces 16 of the journal box define the outside surfaces of metal plate members 21 which are also suitably fixed, as by welding, to integral extensions 22 which extend from the main body 20 of the journal box 14.

In accordance with the teachings of this invention an improved U-shaped pedestal liner is provided and designated generally by the reference numeral 24.

Figure 3:
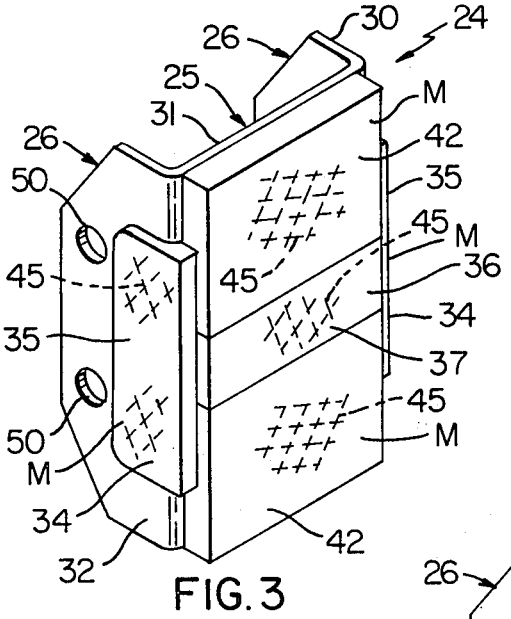
FIG. 3 is a perspective view of the pedestal liner of FIGS. 1 and 2.

The U-shaped pedestal liner 24 is best seen in FIG. 3 and comprises a bight which is designated generally by the reference numeral 25 and a pair of parallel legs each designated generally by the reference numeral 26. The pedestal liner 24 is adapted to be disposed between an associated pedestal leg 13 and journal box 14 and fastened by fastening means 27 to an associated pedestal leg 13 and the fastening means 27 will be described in detail subsequently.

Figure 4:
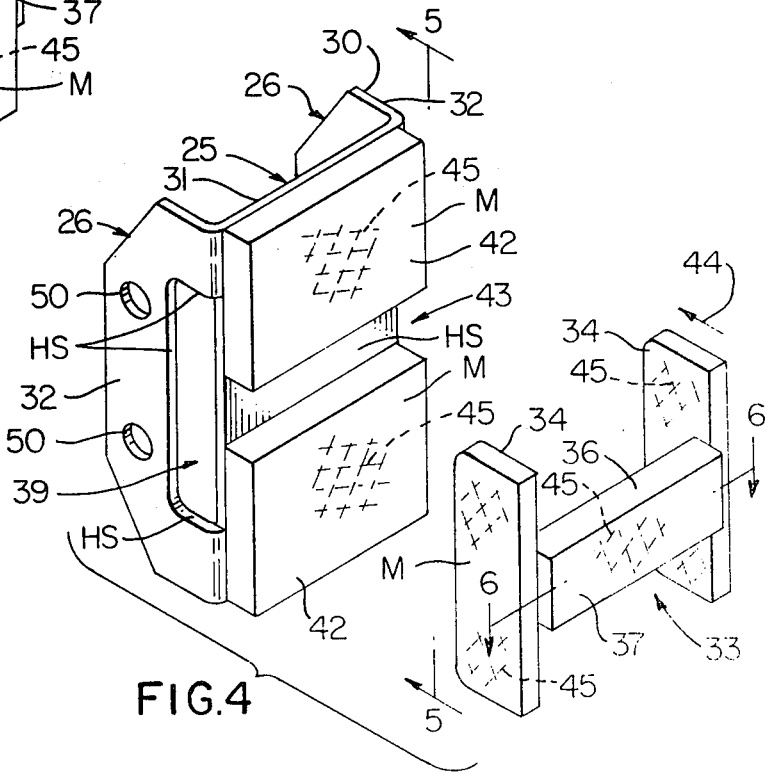
FIG. 4 is an exploded perspective view of the pedestal liner of FIG. 3 particularly illlustrating an insert thereof exploded away from the remaining portion of the pedestal liner.

Referring now to FIG. 4 it is seen that the pedestal liner 24 comprises a roughly U-shaped metal support 30 which comprises the main structural portion of the liner 24 and the metal support 30 has a bight 31 and a pair of parallel legs each designated by the same reference numeral 32. The pedestal liner 24 has antifriction material M (FIG. 2) for parallel legs 26 and such antifriction material is supported by the metal support 30 and is adapted to engage the side surfaces 16 of the journal box 14. The pedestal liner 24 also has antifriction material M for its bight 25 and such antifriction material is supported by the metal support 30 and is adapted to engage the guide surface 15 of the journal box 14. The antifriction material M for the parallel legs and bight will also be described in detail subsequently.

Figure 6:
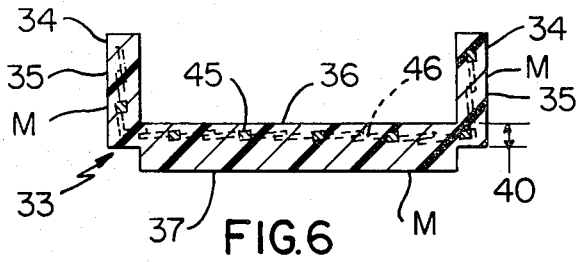
FIG. 6 is a cross-sectional view taken essentially on the line 6—6 of FIG. 4.

The antifriction material for the parallel legs 26 and for the bight 25 comprises an insert which is designated generally by the reference numeral 33 in FIG. 4; and, such insert is comprised of the antifriction material M (FIG. 6). The insert 33 has a pair of roughly parallel members each designated by the same reference numeral 34 which have an outer portions 35 disposed outwardly of and parallel to the parallel legs 32 of the support 30 and the outer portions 35 are adapted to engage the side surfaces 16. The antifriction material M for the parallel legs 26 of the pedestal liner 24 consists solely of the antifriction material M of the roughly parallel members 34 of the insert 33.

The insert 33 has an arm which is designated generally by the reference numeral 36 and the arm extends transverse its parallel members 34. The arm has an outer portion 37 which is adapted to engage the guide surface 15 and the antifriction material M of the arm 36 of the insert 33 comprises the antifriction material of the bight 25 of the pedestal liner 24. The insert 33 is adapted to be readily installed on and removed from the metal support 30 to define the overall pedestal liner 24; and, it will be seen that the liner 33, once installed in position for use, is held in position mainly by surface portions of the metal support as will be described subsequently.

As best seen in FIG. 4 the metal support 30 has cutout means or opening means in at least one of the bight 31 and parallel legs 32 thereof. In this example, the cutout means is a rectangular cutout or opening 39 provided at the junction of each leg 32 with the bight 31. Each cutout 39 defines a surface portion or holding surface HS on its leg 32 and it will be seen that each holding surface HS is defined by the thickness of metal defining the support 30 and extends in a U-shaped configuration.

The insert 33 of this example is substantially H-shaped and it will be seen that the parallel members 34 are disposed in spaced parallel relation and in parallel planes. In addition, the transverse arm 36 is disposed substantially centrally between the members 34 with approximately half of its thickness, indicated at 40 in FIG. 6, coinciding with the members 34 at opposite ends of the arm 36. The arm 36 is disposed in a plane perpendicular to the parallel planes of the members 34.

As seen in FIG. 4 of the drawings, the bight 31 of the metal support 30 is a flat substantially rectangular sheet-like portion and the antifriction material for the bight 25 of the overall liner 24 comprises a pair of antifriction members each designated by the same reference numeral 42. The members 42 are of rectangular outline and are fixed to opposite end portions of the rectangular portion defining the bight 31 with a space 43, also of rectangular outline, between the members 42. The space 43 is adapted to receive the rectangular outline transverse arm 36 of the insert 33 in nested relation therewithin so that there is virtually a planar interface contact between each side of arm 36 and its associated member 42. The central part of the rectangular portion of the bight 31 also defines a holding surface HS for the insert 33 and the surfaces of the members 42 which face each other across the space 43 basically are free of loads imposed by the insert 33 and usually do not function as holding surfaces.

The insert 33 is adapted to be installed in position on its metal support 30 by general movement thereof, as indicated by the arrow 44 in FIG. 4, in a general movement direction determined by movement from the bight 31 of the metal support 30 toward the rear portion of its parallel legs 32. As indicated previously, the insert 33 is basically held in position once installed on a pedestal truck mainly by the surface portions or holding surfaces HS of the metal support 31.

Figure 5:
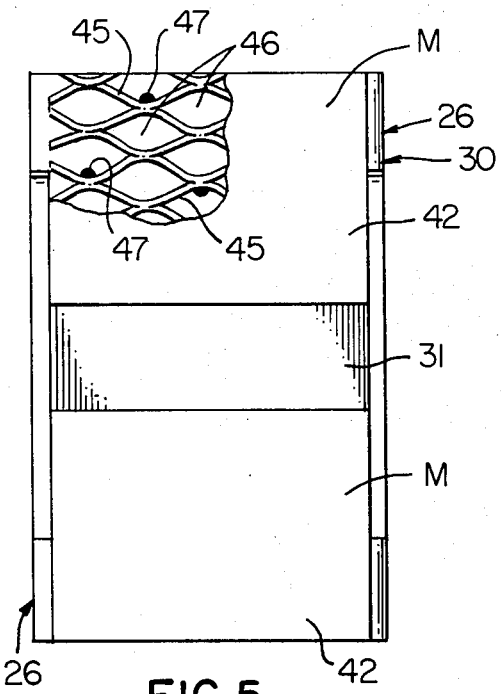
FIG. 5 is a view taken essentially on line 5—5 of FIG. 4 with a fragmentary portion of the pedestal liner broken away to illustrate reinforcing means utilized in polymeric material comprising the upper portion of the bight of such liner.

As indicated previously, the bight 31 of the U-shaped metal support 30 has a pair of antifriction members 42 fixed to opposite end portions of the rectangular configuration of such bight. Each member 42 is also of rectangular outline and is comprised of an antifriction material M preferably in the form of ultra high molecular weight polymeric material, such as polyethylene. Each member 42 has reinforcing means, preferably in the form of a metal reinforcing structure 45, suitably embedded therein (FIGS. 4 and 5) with the reinforcing structure 45 having openings 46 provided therein. The reinforcing structure 45 may be any suitable structure known in the art; however, in this example of the invention such reinforcing structure is in the form of an expanded metal structure. The expanded metal structure 45 is fixed to the bight 31 by any suitable means, such as spot welds 47, for example, whereupon the polymeric material M comprising each member 42 is formed in position therearound. The polymeric material M (which is preferably a molten thermoplastic material) flows through the openings 46 in the reinforcing structure 45 with the polymeric material M serving as a matrix for the reinforcing structure. The reinforcing structure 45 reinforces the polymeric material M while preventing cold flow thereof.

The insert 33 (FIG. 6) has reinforcing means embedded therein, preferably in the form of expanded metal structure 45. The metal structure 45 is embedded in polymeric material M comprising the parallel members 34 and transverse arm 36 thereof and such reinforcing structure 45 also has openings 46 therein which enable flow of material M therethrough and embedment of the structure 45 with the reinforcing material M serving as a matrix for such structure. The reinforcing structure 45 provides reinforcement while preventing cold flow of the polymeric material M, which is also an ultra high molecular weight polymeric material.

The reinforcing structure 45 for the insert 33 is preferably a single-piece metal structure, as best illustrated in FIG. 6 of the drawings, and it will be appreciated that such structure is disposed in an H-shaped configuration corresponding to the H-shaped configuration of the insert 33 and has parallel portions disposed in parallel planes centrally within the members 34 and a transverse portion which is disposed in arm 36 in a plane perpendicular to the parallel planes of the portions within arms 34.

The H-shaped reinforcing structure 45 of insert 33 improves the structural integrity of such insert; and, the polymeric material M of insert 33 defines the exposed or outside surfaces thereof whereby the material M assures that the exposed surfaces of the insert have optimum antifriction properties.

The pedestal liner 24 has means for fastening same to an associated pedestal leg 13; and, in this example of the invention the fastening means comprises a plurality of cylindrical shape holes or bores in the legs 32 of the metal support 30 and each bore is designated by the same reference numeral 50. Each bore is particularly adapted to receive an associated fastener such as a threaded fastening bolt 51 therethrough and for the purpose of fastening the metal support 30 and hence the entire pedestal liner 24 to its pedestal leg 13. Each fastening bolt 51 is threadedly received within a cooperating threaded opening (not shown) in the pedestal leg 13.

Figure 8:
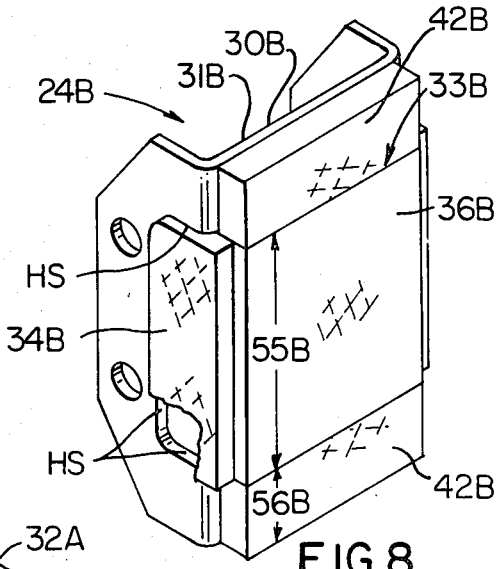
FIG. 8 is a view similar to FIG. 3 illustrating another exemplary embodiment of the pedestal liner of this invention.
Figure 7:
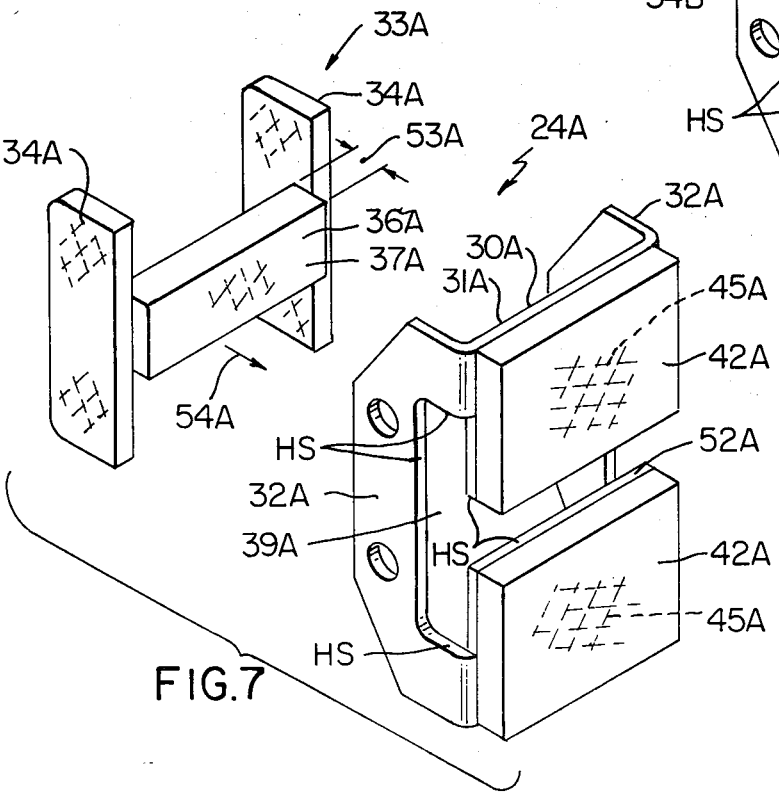
FIG. 7 is a view similar to FIG. 4 illustrating another exemplary embodiment of the pedestal liner of this invention.
Figure 9:
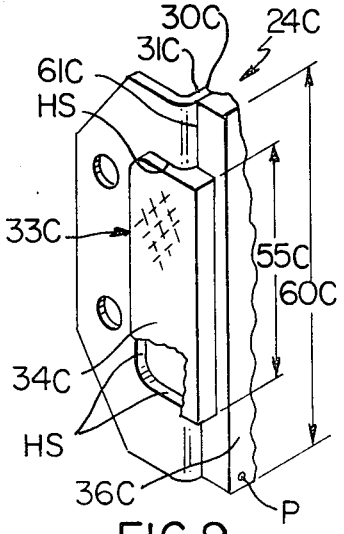
FIG. 9 is a view similar to FIG. 3 illustrating another exemplary embodiment of the pedestal liner of this invention and with portions of such liner broken away.

Other exemplary embodiments of the pedestal liner of this invention are illustrated in FIGS. 7, 8, and 9 of the drawings. The pedestal liners of FIGS. 7, 8, and 9 are very similar to the pedestal liner 24, therefore such pedestal liner will be designated by the reference numeral 24A, 24B and 24C respectively and representative parts of each pedestal liner which are similar to corresponding parts of the pedestal liner 24 will be designated in the drawings by the same reference numerals as in the pedestal liner 24 (whether or not such representative parts are mentioned in the specification) followed by the associated letter designation A, B, or C respectively. Only those component parts of the pedestal liner 24A, 24B, and 24C which are different from corresponding parts of the pedestal liner 24 will be designated by a new reference numeral also followed by the associated letter designation A, B, or C.

The pedestal liner 24A (FIG. 7) also has a U-shaped metal support 30A provided with a bight 31A and parallel legs 32A extending from opposite ends of the bight; however, the flat substantially rectangular portion defining the bight 31A has a central cutout 52A therein which is basically of rectangular outline. The pedestal liner 24A also has a pair of antifriction members 42A each provided with reinforcing structure 45A suitably fixed to opposite end portions thereof in a similar manner as previously described for the pedestal liner 24. The pedestal liner 24A also has an insert 33A which is similar to the insert 33 and is comprised of a pair of parallel members 34A and a transverse arm 36A; however, the transverse arm 36A has a thickness 53A which is greater than the corresponding thickness of the arm 36 by an amount roughly equal to the thickness of the bight 31A of support 30A.

The construction and arrangement of the insert 33A is such that it is adapted to be installed in position by movement thereof through the parallel legs 32A of the metal support 30A in a general direction indicated by the arrow 54A in FIG. 7 and with such movement being generally through the parallel legs 32A and toward the bight 31A of the metal support 30A. At the completion of the movement in the direction 54A, the insert 33A assumes a position such that the liner 24A has an outside appearance which is substantially identical to the pedestal liner 24 illustrated in FIG. 3 whereby the exposed outer portion 37A of the transverse arm 36A of the insert 33A is disposed so that its outside surface is coplanar with the outside surfaces of the members 42A. In addition, the parallel members 34A have outside configurations which correspond to cutout means 39A in the arms 32A of the metal support 30A and the dimensions of the transverse arm 36A correspond to dimensions of the cutout 52A whereby once the insert 33A is installed within U-shaped metal support 30A with the members 42A fixed in position the insert 33A is held by holding surfaces HS of the metal support 30A and may be readily removed and replaced upon excessive wear of its parallel members 34A as well as excessive wear of its central transverse arm 36A.

The main difference between the pedestal liner 24B, of FIG. 8, and the pedestal liner 24 is that the pedestal liner 24B instead of having an insert of H-shaped configuration has an insert 33B of substantially U-shaped configuration. Accordingly, the transverse arm 36B thereof has a vertical height 55B which is equal to the vertical height of the arms 34B. Further, in order to receive the insert 33B the vertical dimension 56B of each member 42B is comparatively small and the arm 36B is backed by a portion of the bight 31B of support 30B which has a vertical height corresponding to the height 55B.

The main difference between the pedestal liner 24C of FIG. 9 and the pedestal liner 24 is that the insert 33C thereof has a transverse arm 36C which has a vertical dimension 60C which is greater than the vertical dimension 55C of the parallel members 34C. However, the transverse arm 36C has a rear surface 61C which is completely supported against movements toward the bight 31C of support 30C, and this is achieved beacuse the bight 31C has a planar uninterrupted surface which supports surface 61C.

The pedestal liner of this invention may be made utilizing method steps as disclosed herein and is preferably made by forming an insert which has a pair of roughly parallel members disposed in spaced parallel planes and an arm extending transverse to and interconnecting the parallel members with such arm being disposed in a plane perpendicular to the parallel planes. As described earlier, the transverse arm may have a vertical height which is substantially less than the vertical height of the parallel members and may be centrally disposed therealong whereby such insert may have a substantially H-shaped configuration as illustrated in FIGS. 4 and 7 for the inserts 33 and 33A. Similarly, the transverse arm may have a vertical height which is substantially equal to the vertical height of the parallel members whereby such insert may have a substantially U-shaped configuration as illustrated in FIG. 8 for the insert 33B. Finally, the transverse arm of the insert may have a vertical height which is greater than the vertical height of its parallel members and indeed the vertical height of the transverse arm may extend over substantially the entire vertical height of the overall pedestal liner and essentially as illustrated in FIG. 9 by the insert 33C.

However, regardless of whether insert 33, 33A, 33B, or 33C is being formed or constructed, the method of making the pedestal liner of this invention comprises the steps of providing cutout means in at least one of the bight and parallel legs of a metal support and disposing one of the four types of insert within the cutout means such that the insert is held in position by holding surfaces comprising the metal support. The insert is disposed within the cutout means such that such insert has outer portions disposed outwardly of and parallel to the parallel legs of the metal support with the outer portions being adapted to engage the side surfaces of an associated journal box and with the transverse arm of the insert having an outer portion which is adapted to engage the guide surface of such associated journal box.

The cutout means in the metal support 30 of the pedestal liner 24 referred to above comprises cutout means or a cutout 39 provided in the parallel legs 32 of the metal support 30. The cutout means provided in the metal support 30A of pedestal liner 24A comprises a cutout 39A provided in the parallel legs 32A of the metal support 30A as well as the rectangular cutout 52A provided in the bight 31A of such metal support. The cutout means provided in the metal support 30B of the pedestal liner 24B comprises cutout means or a cutout 39B provided in the legs 32B of the metal support 30B. Finally, the cutout means provided in the metal support 30C of the pedestal liner 24C comprises cutout means or a cutout 39C provided in the parallel legs 32C of the metal support 30C.

In each of these instances with the cutouts as described each insert 33, 33A, 33B, and 33C is basically held in position by holding surfaces, designated by the reference letters HS, in the metal support of its pedestal liner. In particular, each holding surface HS is defined in the parallel legs of each associated U-shaped metal support 30, 30A, 30B, and 30C. In the case of the pedestal liner 24A the holding surfaces, in addition to the surfaces HS in legs 32A of support 30A, include holding surfaces also designated HS which comprise opposed surfaces defining the cutout 52A in the bight 31A of metal support 30A as shown in FIG. 7 of the drawings.

Each insert 33, 33A, 33B, and 33C may be formed utilizing any suitable technique known in the art; however, each insert is preferably formed by first forming the reinforcing structure 45 which is to be embedded within polymeric material M defining each insert. The forming may be achieved utilizing commercially available forming tools, fixtures, and the like; and, each reinforcing structure is preferably formed using a single-piece metal structure which has openings therein as previously described.

After forming the reinforcing structure for each insert, such reinforcing structure is disposed in an associated mold device and the cooperating components of the mold device are such that they define the final conifguration of the insert. With the reinforcing structure suitably supported within the mold device polymeric material M, preferably in the form of a molten thermoplastic material is injected into the mold device under high temperature and pressure conditions, as is known in the art. After injection of the thermoplastic polymeric material, the mold device and polymeric material are suitably cooled whereupon the mold device is disassembled and the insert is removed from such mold device. The completed inserts 33, 33B, and 33C are adapted to be installed in position by movement of each toward their metal support as shown typically by the direction arrow 44 for the insert 33. The insert 33A is installed in position by movement thereof in an opposite direction relative to its support, as shown by the direction arrow 54A.

Reference has been made throughout this disclosure to the holding surfaces HS of each metal support holding each insert to its pedestal liner and this applies to each pedestal liner 24, 24A, 24B, and 24C.

However, it is to be understood that the holding action is basically a confining action whereby each insert is held or confined in position once its pedestal liner is fastened to its pedestal leg and the pedestal leg and pedestal liner are placed in their normal operative association with a journal box 14.

It will also be appreciated that in some applications one or more pins may be used to help hold an insert on its metal support. A typical pin P is shown acting between the insert 33C of the pedestal liner 24C and the bight 31C of its metal support 30C.

Reference has been made throughout this specification to the use of ultra high molecular weight material, such as polyethylene, to define the polymeric material M of each insert and to define the polymeric material M of each member fixed to the bight of the metal support of each pedestal liner 24, 24A, 24B, and 24C. The molecular weight referred to is at least two million and preferably the molecular weight is within the range of four to six million using polyethylene. In addition, the preferred technique for determining this molecular weight is referred to as the intrinsic viscosity test and is widely used in the United States.

While the inserts 33, 33A, 33B, and 33C each have the member 34, 34A, 34B or 34C for at least one leg 32, 32A, 32B or 32C be provided with a holding means or arm 36, 36A, 36B or 36C, as well as the other member 34, 34A, 34B or 34C, that is respectively disposed outboard of the respective cutout 39, 39A, 39B or 39C for holding that member or insert in its respective cutout or opening, it is to be understood that the insert for each leg of the U-shaped metal support of this invention could be a separate insert which has its own holding means extending outboard of the opening receiving such insert to hold that insert in the opening rather than require the holding means to comprise part of the antifriction material for the bight 31, 31A, 31B or 31C of the U-shaped support, as well as part of the other member 34, 34A, 34B or 34C thereof.

For example, reference is now made to FIGS. 10–14 wherein another pedestal liner of this invention is generally indicated by the reference numeral 24D and parts thereof similar to the pedestal liners 24, 24A, 24B and 24C previously described are indicated by like reference numerals followed by the reference letter "D".

Figure 11:
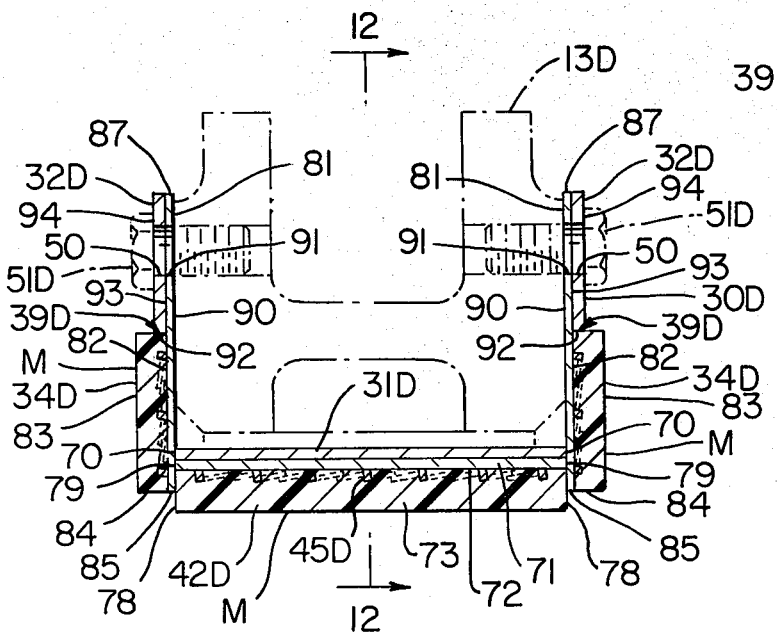
FIG. 11 is a cross-sectional view taken on line 11—11 of FIG. 10 and illustrates by dash-dotted lines a pedestal leg and means fastening the pedestal liner of FIG. 10 thereto.
Figure 13:
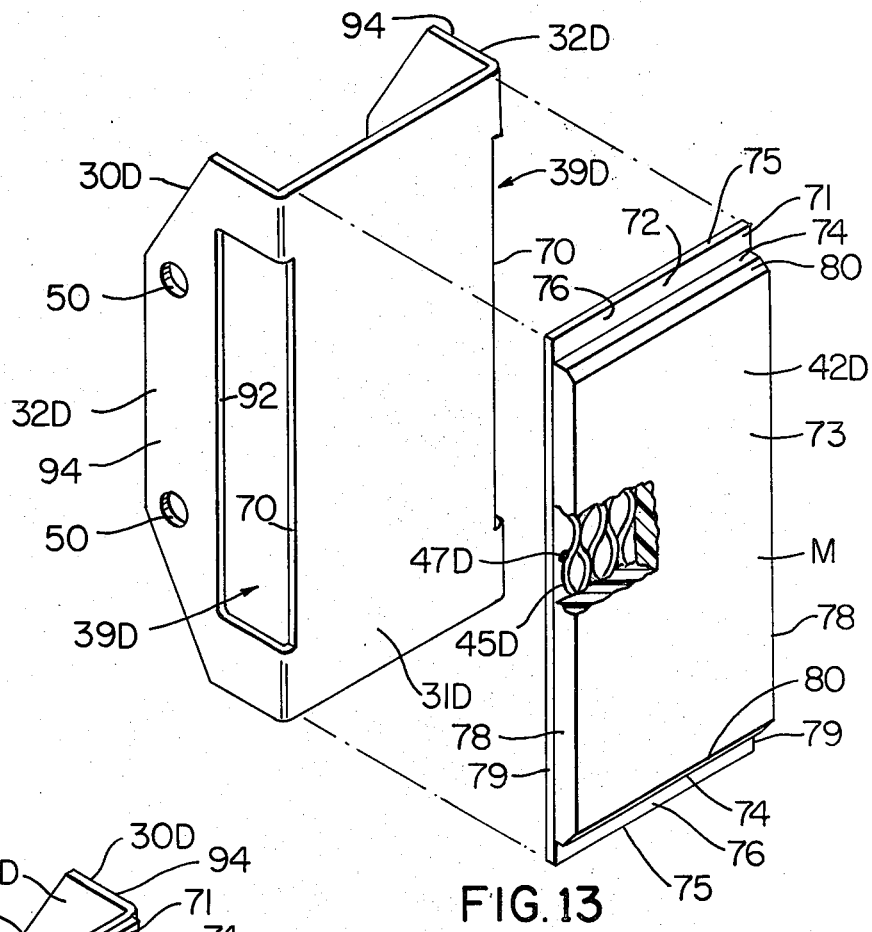
FIG. 13 is an exploded perspective view illustrating a step in the method of this invention for making the pedestal liner of FIG. 10.

As illustrated in FIG. 13, the U-shaped metal support 30D has the cutout 39D formed in each leg 32D thereof in the manner previously described, each cutout 39D defining an end edge 70 of the bight 31D for a purpose hereinafter described. Thus, it can be seen that the U-shaped metal support 30D of the pedestal liner 24D of this invention is substantially identical to the U-shaped supports 30, 30A, 30B and 30C previously described as the legs 32D of the U-shaped support 30D have the mounting holes 50 disposed outboard of the cutouts 31D thereof for attaching to the pedestal leg 13D by the threaded fastening members 51D as illustrated in FIG. 11 in a manner hereinafter set forth.

The antifriction means 42D for the bight 31D of the U-shaped support 30D comprises a substantially rectangular metal plate 71 that carries the antifriction material M on the front surface 72 thereof, the antifriction material M being reinforced by the metal reinforcing structure 45D that has been secured to the front surface 72 of the plate 71, such as by the spot welds 47D in the manner previously set forth, to have the antifriction material M secured thereto in the manner previously set forth.

Figure 10:
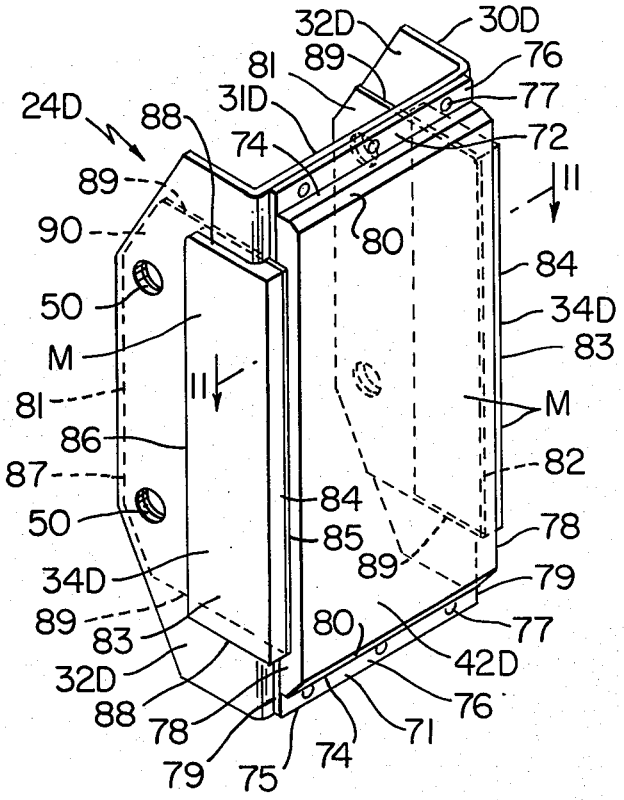
FIG. 10 is a view similar to FIG. 3 illustrating another exemplary embodiment of the pedestal liner of this invention.
Figure 12:
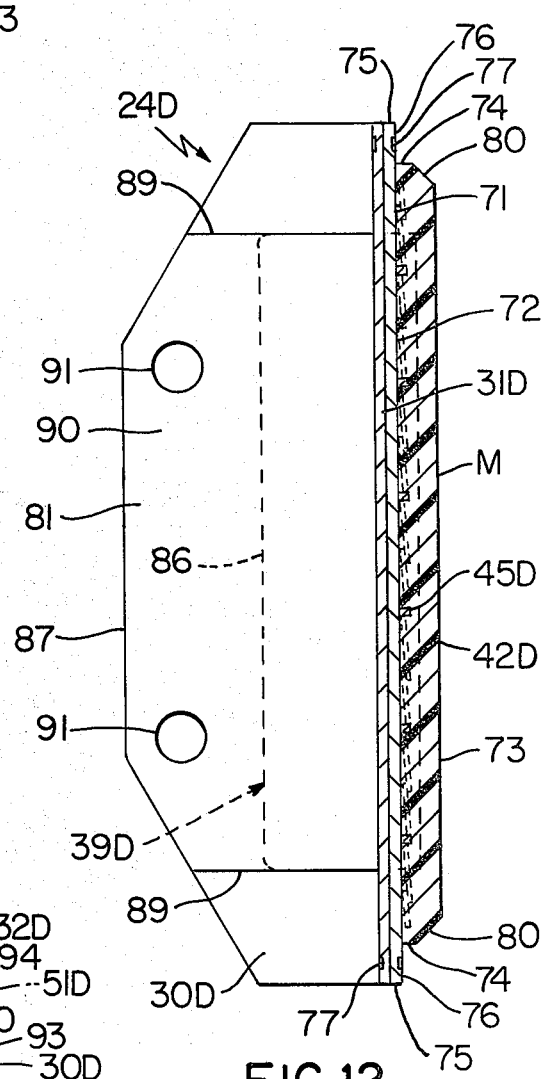
FIG. 12 is an enlarged cross-sectional view taken on line 12—12 of FIG. 11.
Figure 14:
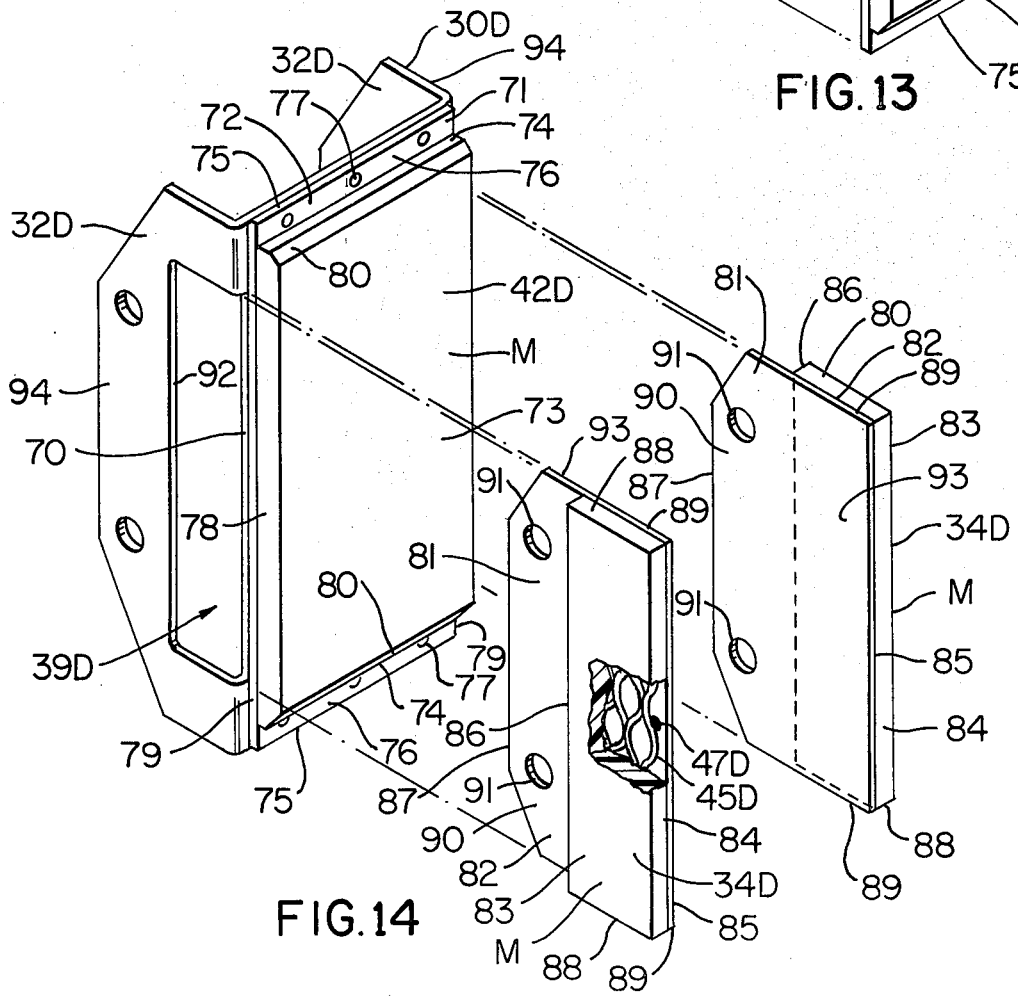
FIG. 14 is an exploded perspective view similar to FIG. 13 and illustrates another step in the method of this invention for making the pedestal liner of FIG. 10.

However, the antifriction material M is formed on the plate 71 as a substantially rectangular block structure 73 having opposed ends 74 that are disposed short of the opposed ends 75 of the plate 71 so as to define bands 76 of the plate 71 which are exposed for attaching the plate 71 directly to the bight 31D of the U-shaped support 30D, such as by spot welding as indicated by the reference numerals 77 in FIGS. 10 and 14. However, the other opposed side edges 78 of the rectangular antifriction member 73 respectively extend so as to be coplanar with the opposed side edges 79 of the plate 71 for a purpose hereinafter described, the side edges 78 and 79 of the material 73 and plate 71 being respectively coplanar with the end edges 70 of the bight 31D of the metal support 30D in the manner illustrated in FIGS. 11 and 14 for a purpose hereinafter set forth.

In order to facilitate the welding of the plate 71 to the bight 31D of the U-shaped support 30D, the end edges 74 of the rectangular block 73 of antifriction material M can be beveled at 80 as illustrated.

The inserts or members 34D for the legs 32D of the U-shaped support 30D comprise a pair of separate plates 81, one plate 81 being for each leg 32D and carrying on the side 82 thereof the substantially rectangular block 83 of antifriction material M which is fastened to the plate 81 by the metal reinforcing means 45D that has been welded to the side 82 of the plate 81 by the spot welds 47D in the same manner as the metal reinforcing means 45D of the bight antifriction member 73 previously described.

The antifriction block 83 for each plate 81 has one side edge 84 thereof disposed coplanar with an end edge 85 of the plate 81 with the other edge 86 thereof being spaced from the opposed end edge 87 of the plate 81. In contrast, the top and bottom edges 88 of the block 83 are disposed substantially coplanar with the top and bottom end edges 89 of the respective plate 81.

The portion of the plate 81 that extends beyond the end edge 86 of the block 83 of antifriction material M comprises an arm or holding means 90 and has a pair of mounting holes 91 formed therethrough that are adapted to be disposed in aligned relation with the mounting holes 50 of the respective leg 32D when the insert 34D is inserted into the respective cutout 39D in the manner illustrated in FIG. 14 to the fully assembled position illustrated in FIGS. 10 and 11 so as to be fastened by the fastening means 51D directly to the pedestal leg 13D as illustrated in FIG. 11.

Therefore, it can be seen that the plates 81 have the arms 90 thereof providing the holding means for holding the insert 34D thereof in the respective cutout 39D, the fastening means 51D further fastening the arms 90 directly to the respective legs 32D of the U-shaped support member 30D as illustrated in FIG. 11 as well as to the pedestal leg 13D.

When the insert 34D is fully inserted in its respective cutout 39D of the respective leg 32D, it can be seen that the end edge 86 of the antifriction block 83 abuts against the end edge 92 of the leg 32D defined by the cutout 39D while the side 93 of the plate 81 not only abuts against the end edge 70 of the bight 31D of the metal support 30D but also abuts against the end edge 79 of the plate 71 and end edge 78 of the antifriction block 73 as illustrated in FIG. 11 to positively hold the block or member 34D outboard of and parallel to the outer surface 94 of the respective leg 32D so that the insert 34D can provide its cooperating function with the journal box in the manner previously set forth for the other members 34, 34A, 34B or 34C.

Thus, it can be seen that should one or both of the leg inserts 34D wear out sooner than the material 73 on the bight 31D of a particular pedestal liner 24D, the worn out insert 34D can be readily replaced by unfastening the bolts 51D thereof and sliding out the respective plate 81 and inserting a new plate 81 in place thereof to provide a new insert or member 34D for that particular leg 32D without requiring a substitution of both of the leg inserts 34D as is the case in the embodiments provided by the pedestal liners 24, 24A, 24B and 24C as previously set forth.

Nevertheless, it can be seen that in all of the embodiments of the pedestal liners 24, 24A, 24B, 24C and 24D of this invention, the antifriction polymeric material for at least one of the parallel legs of the liner comprises an insert comprised of the antifriction polymeric material and being carried by a U-shaped metal support, the insert having a roughly parallel member which has an outer portion disposed outwardly of and parallel to one of the parallel legs of the support with the outer portion being adapted to engage the respective side surface of the journal box. That parallel member of the insert comprises antifriction polymeric material for that one parallel leg of the liner and that one parallel leg of the support has an opening therethrough adjacent the bight of the support and receiving the insert therein. The insert has holding means extending outboard of the opening for cooperating with the liner to hold the insert in the opening, the holding means being the part 36, 36A, 36B, 36C or the arms 90 of the respective liner 24, 24A, 24B, 24C or 24D.

While present exemplary embodiments of this invention, and methods of practicing the same, have been illustrated and described, it will be recognized that this invention may be otherwise variously embodied and practiced within the scope of the following claims.

What is claimed is:

1. In a pedestal liner for a railway vehicle wherein said vehicle comprises: pedestal trucks comprising pairs of pedestal legs; a journal box disposed between each associated pair of pedestal legs; each journal box having a vertically disposed planar guide surface and a pair of spaced vertically disposed parallel side surfaces disposed on opposite sides of said guide surface; said pedestal liner being roughly U-shaped and comprising: a bight and a pair of parallel legs and being adapted to be disposed between an associated pedestal leg and journal box and fastened to the associated pedestal leg; a roughly U-shaped metal support comprising the main structural portion of said liner; said metal support also having a bight and a pair of parallel legs; antifriction polymeric material for said parallel legs of said liner supported by said metal support and adapted to engage said side surfaces; and antifriction polymeric material for said bight of said liner supported by said metal support and adapted to engage said guide surface; said antifriction polymeric material being ultra high molecular weight polymeric material; the improvement in which, said antifriction polymeric material for at least one of said parallel legs of said liner comprises an insert comprised of said antifriction polymeric material and being carried by said metal support, said insert having a roughly parallel member which has an outer portion disposed outwardly of and parallel to one of said parallel legs of said support with said outer portion being adapted to engage the respective said side surface, said parallel member comprising said antifriction polymeric material for said one parallel leg of said liner, said one parallel leg of said support having an opening therethrough adjacent said bight of said support and receiving said insert therein, said insert having holding means extending beyond the edges of said opening for cooperating with said support to hold said insert in said opening.

2. A pedestal liner as set forth in claim 1 in which said holding means of said insert comprises at least part of said antifriction polymeric material of said bight of said liner.

3. In a pedestal liner for a railway vehicle wherein said vehicle comprises: pedestal trucks comprising pairs of pedestal legs; a journal box disposed between each associated pair of pedestal legs; each journal box having a vertically disposed planar guide surface and a pair of spaced vertically disposed parallel side surfaces disposed on opposite sides of said guide surface; said pedestal liner being roughly U-shaped and comprising: a bight and a pair of parallel legs and being adapted to be disposed between an associated pedestal leg and journal box and fastened to the associated pedestal leg; a roughly U-shaped metal support comprising the main structural portion of said liner; said metal support also having a bight and a pair of parallel legs; antifriction polymeric material for said parallel legs of said liner supported by said metal support and adapted to engage said side surfaces; and antifriction polymeric material for said bight of said liner supported by said metal support and adapted to engage said guide surface; said antifriction polymeric material being ultra high molecular weight polymeric material; the improvement in which, said antifriction polymeric material for at least one of said parallel legs of said liner comprises an insert comprised of said antifriction polymeric material and being carried by said metal support, said insert having a roughly parallel member which has an outer portion disposed outwardly of and parallel to one of said parallel legs of said support with said outer portion being adapted to engage the respective said side surface, said parallel member comprising said antifriction polymeric material for said one parallel leg of said liner, said one parallel leg of said support having an opening therethrough adjacent said bight of said support and receiving said insert therein, said insert having holding means extending in a direction away from said guide surface and beyond said opening for cooperating with said support to hold said insert in said opening, said holding means of said insert comprising an attaching member adapted to be secured to said one parallel leg of said support, said antifriction polymeric material of said insert being carried by said attaching member.

4. A pedestal liner as set forth in claim 3 in which said attaching member extends parallel to said one parallel leg of said support and inboard of the same.

5. A pedestal liner as set forth in claim 4 in which said one parallel leg of said support has holes passing therethrough for fastening that leg of said support to said pedestal leg by fastening means passing through said holes, said attaching member having holes therethrough aligned with said holes of said one parallel leg of said support to be fastened thereto by said fastening means.

6. A pedestal liner as set forth in claim 5 in which said attaching member comprises a substantially flat plate having opposed substantially flat surfaces, said antifriction material of said insert being secured to one of said surfaces of said plate.

7. A pedestal liner as set forth in claim 6 in which said opening in said one parallel leg of said support defines an end edge of said bight of said support, said plate having the other of said surfaces thereof abutting said end edge of said bight of said support.

8. A pedestal liner as set forth in claim 7 in which said plate comprises metallic material.

9. A pedestal liner as set forth in claim 7 in which a backing member is carried by said bight of said support, said backing member carrying said antifriction polymeric material of said bight, said backing member having an end edge adjacent said end edge of said bight of said support, said other surface of said plate also abutting said end edge of said backing member.

10. A pedestal liner as set forth in claim 9 in which said packing member comprises metallic material.

11. In a method of making a pedestal liner for a railway vehicle wherein said vehicle comprises: pedestal trucks comprising pairs of pedestal legs; a journal box disposed between each associated pair of pedestal legs; each journal box having a vertically disposed planar guide surface and a pair of spaced vertaically disposed parallel side surfaces disposed on opposite sides of said guide surface; said method comprising the steps of: forming a metal support to define a roughly U-shaped configuration therein wherein said support has a bight and a pair of parallel legs extending from opposite side edges of said bight; supporting antifriction polymeric material on said bight of said metal support for engaging said guide surface; and supporting antifriction polymeric material on said parallel legs of said metal support for engaging said side surfaces; said antifriction polymeric material being ultra high molecular weight polymeric material; the improvement comprising the steps of: forming said antifriction polymeric material for at least one of said parallel legs of said liner to comprise an insert comprised of said antifriction polymeric material and being carried by said metal support, forming said insert to have a roughly parallel member which has an outer portion disposed outwardly of and parallel to one of said parallel legs of said support with said outer portion being adapted to engage the respective said side surface, forming said parallel member to comprise said antifriction polymeric material for said one parallel leg of said liner, forming said one parallel leg of said support to have an opening therethrough adjacent said bight of said support and receiving said insert therein, and forming said insert to have holding means extending beyond the edges of said opening for cooperation with said support to hold said insert in said opening.

12. A method of making a pedestal liner as set forth in claim 11 and including the step of forming said holding means of said insert to comprise at least part of said antifriction polymeric material of said bight of said liner.

13. In a method of making a pedestal liner for a railway vehicle wherein said vehicle comprises: pedestal trucks comprising pairs of pedestal legs; a journal box disposed between each associated pair of pedestal legs; each journal box having a vertically disposed planar guide surface and a pair of spaced vertically disposed parallel side surfaces disposed on opposite sides of said guide surface; said method comprising the steps of: forming a metal support to define a roughly U-shaped configuration therein wherein said support has a bight and a pair of parallel legs extending from opposite side edges of said bight; supporting antifriction polymeric material on said bight of said metal support for engaging said guide surface; and supporting antifriction polymeric material on said parallel legs of said metal support for engaging said side surfaces; said antifriction polymeric material being ultra high molecular weight polymeric material; the improvement comprising the steps of: forming said antifriction polymeric material for at least one of said parallel legs of said liner to comprise an insert comprised of said antifriction polymeric material and being carried by said metal support, forming said insert to have a roughly parallel member which has an outer portion disposed outwardly of and parallel to one of said parallel legs of said support with said outer portion being adapted to engage the respective said side surface, forming said parallel member to comprise said antifriction polymeric material for said one parallel leg of said liner, forming said one parallel leg of said support to have an opening therethrough adjacent said bight of said support and receiving said insert therein, forming said insert to have holding means extending in a direction away from said guide surface and beyond said opening for cooperation with said support to hold said insert in said opening, forming said holding means of said insert to comprise an attaching member adapted to be secured to said one parallel leg of said support, and causing said antifriction polymeric material of said insert to be carried by said attaching member.

14. A method of making a pedestal liner as set forth in claim 13 and including the step of forming said attaching member to extend parallel to said one parallel leg of said support and inboard of the same.

15. A method of making a pedestal liner as set forth in claim 14 and including the steps of forming said one parallel leg of said support to have holes passing therethrough for fastening that leg of said support to said pedestal leg by fastening means passing through said holes, and forming said attaching member to have holes therethrough aligned with said holes of said one parallel leg of said support to be fastened thereto by said fastening means.

16. A method of making a pedestal liner as set forth in claim 15 and including the steps of forming said attaching member to comprise a substantially flat plate having opposed substantially flat surfaces, and securing said antifriction material of said insert to one of said surfaces of said plate.

17. A method of making a pedestal liner as set forth in claim 16 and including the steps of forming said opening in said one parallel leg of said support to define an end edge of said bight of said support, and abutting the other of said surfaces of said plate against said end edge of said bight of said support.

18. A method of making a pedestal liner as set forth in claim 17 and including the step of forming said plate from metallic material.

19. A method of making a pedestal liner as set forth in claim 17 and including the steps of providing a backing member to be carried by said bight of said support, forming said antifriction polymeric material of said bight to be carried by said backing member, forming said backing member to have an end edge adjacent said end edge of said bight of said support, and abutting said other surface of said plate also against said end edge of said backing member.

20. A method of making a pedestal liner as set forth in claim 19 and including the step of forming said backing member from metallic material.

* * * * *